US008317058B2

(12) United States Patent
Toth et al.

(10) Patent No.: US 8,317,058 B2
(45) Date of Patent: Nov. 27, 2012

(54) BICYCLISTS' WATER BOTTLE WITH BOTTOM DRINKING VALVE

(75) Inventors: Shirley A. Toth, Rome, NY (US); E. Paul Ratazzi, Rome, NY (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 879 days.

(21) Appl. No.: 11/591,661

(22) Filed: Oct. 31, 2006

(65) Prior Publication Data

US 2008/0006644 A1 Jan. 10, 2008

Related U.S. Application Data

(60) Provisional application No. 60/819,149, filed on Jul. 5, 2006.

(51) Int. Cl.
*A47G 19/22* (2006.01)

(52) U.S. Cl. ..... 220/710; 215/389

(58) Field of Classification Search ..... 220/710, 220/345.1; 215/11.5, 388, 389; 222/211, 222/572; 239/33

See application file for complete search history.

(56) References Cited

U.S. PATENT DOCUMENTS

| | | | | |
|---|---|---|---|---|
| D167,273 | S * | 7/1952 | Nusbaum | D24/197 |
| 4,645,097 | A * | 2/1987 | Kaufman | 222/207 |
| 4,940,151 | A * | 7/1990 | Fett | 215/11.1 |
| 6,006,952 | A * | 12/1999 | Lucas | 222/211 |
| 2003/0183596 | A1* | 10/2003 | Lombardo | 215/11.5 |
| 2004/0256345 | A1* | 12/2004 | Lundquist | 215/11.5 |

* cited by examiner

*Primary Examiner* — Anthony Stashick
*Assistant Examiner* — Jeffrey Allen
(74) *Attorney, Agent, or Firm* — Joseph A. Mancini

(57) ABSTRACT

Apparatus for dispensing water or other liquids to a bicyclist while riding. Invention provides a means for dispensing fluids from its bottom end so as to eliminate the need for inverting. Contents of the bottle are gravity-dispensed so as to eliminate repeated squeezing of bottle to discharge contents. Invention incorporates functional ergonomic elements including recesses for better handhold, concave sections and extended sections to provide a close conformity to a bicyclist's face to both preserve the aerodynamics of the bicyclist and for maintaining adequate clearance for breathing, while drinking from the invention. Invention is compatible with prior art carriage and retention systems.

2 Claims, 4 Drawing Sheets

BICYCLISTS' WATER BOTTLE WITH BOTTOM DRINKING VALVE

PRIORITY CLAIM UNDER 35 U.S.C. §119(e)

This patent application claims the priority benefit of the filing date of provisional application Ser. No. 60/819,149, having been filed in the United States Patent and Trademark Office on Jul. 5, 2006 and now incorporated by reference herein.

STATEMENT OF GOVERNMENT INTEREST

The invention described herein may be manufactured and used by or for the Government of the United States of America for governmental purposes without the payment of any royalty thereon.

BACKGROUND OF THE INVENTION

1. Technical Field of the Invention

This invention relates generally to the field of sports hydration. More specifically the present invention relates hydration systems for bicyclists and other sports participants where maintaining a particular physical position or posture while at the same time consuming a liquid (hydrating) is important to both the participant's competitiveness, efficiency or even safety.

Bicyclists commonly carry water bottles attached to the frame of their bicycle in order to hydrate whilst riding. These bottles in nearly all instances consist of a cylindrical reservoir sealed at the top with a cap containing a valve. To drink, the user must invert the bottle in such a way that the fluid inside the reservoir covers the interior of the valve. The degree of inversion depends on the fluid level within the reservoir, and becomes more severe as the fluid level diminishes with consumption. Even when the fluid level is high, but especially when it becomes low, this inversion of the bottle must be accompanied by a turning or lifting of the head in order to facilitate drinking. When bicycling, especially for long distances or in an aerodynamic or racing position, this turning and/or lifting of the head can be very uncomfortable, awkward, and even dangerous as it may cause the bicyclist to lose balance and/or require them to temporarily look away from the direction of travel.

2. The Prior Art

U.S. Pat. No. 6,457,691B1 to Kao discloses a water bottle clip apparatus which relocates conventional, prior art type bicycling water bottle retention "cages" or "clips" from the bicycle frame's downtube to the handlebar stem. The Kao invention eliminates the need for the cyclist to reach down to retrieve the water bottle from its cage in order to drink from it. Since the invention relocates the water bottle to the handlebar stem, it then becomes possible to drink from it by leaning forward to access the water bottle directly by mouth. However, the Kao invention makes no provision for the vast majority of prior art bicycling water bottles which do not have an integral straw. Moreover, the Kao invention requires an additional expenditure of the cyclist's energy in providing sufficient amounts of suction to draw the liquid from the water bottle through the straw while under significant aerobic stress.

U.S. Pat. No. 5,301,860 to Paczonay is a divisional of U.S. Pat. No. 5,215,231 to Paczonay which discloses an apparatus for supplying water or other liquids to a bicyclist that allows him or her to remain in a riding position while drinking. The invention accomplished this by leaving the water bottle fixed to its holder, which is in turn mounted to the bicycle frame downtube in a conventional manner. Liquid is delivered to the bicyclist's mouth through a delivery tube. The water bottle is compressed by way of a compression means so as to force liquid out of the water bottle and into the delivery tube. A check valve in the delivery tube prevents the flowback of liquid from the delivery tube to the water bottle and claims to eliminate the need to fully recompress the water bottle to facilitate each separate act of drinking. The Paczonay invention provides no compatibility with prior art bicycling water bottle retention systems. Moreover, the delivery tube must be secured to both the bicycle and to the rider at all times with the liquid discharging end necessarily held in the bicyclist's mouth or fastened in the immediate vicinity thereof. Lastly, the compression means comprises mechanical assemblies and associated actuating cables which necessarily add further complexity and weight to the bicycle which may be undesirable and/or impermissible in certain competitive events. It is also entirely conceivable that when the quantity liquid in the water bottle diminishes through consumption, the compression manes will fail to expel the remaining water, therefore necessitating that the bicyclist expend energy in providing sufficient amounts of suction to draw the remaining liquid from the water bottle through the straw while under significant aerobic stress. U.S. Pat. No. 5,301,860 to Paczonay claims only the holding and locking means of the invention.

U.S. Pat. No. 5,301,858 to Hollander discloses a multi sports water bottle intended for bicycle frame mounting to accommodate a bicyclist's hydration needs and also capable of being belt-worn to accommodate a runner or jogger's hydration needs as well. With regard to the bicycle mounted embodiment of the Hollander invention, it provides a "hands free" solution for bicyclists' hydration with apparent compatibility with existing prior art frame mounted water bottle retention systems. The Hollander invention does require the use of a long water delivery tube extending from the water bottle, along the frame downtube and terminating in an articulated neck attached to the bicycle stem. The invention, however, relies upon the bicyclist's ability to expend energy in suctioning the entirety of the liquid from the water bottle through the straw while under significant aerobic stress.

U.S. Pat. No. 5,251,777 to McMahon discloses a water bottle and bracket apparatus intended for mounting on various equipment including bicycles. A feature of the invention provides a means for rotating the bracket relative to the water bottle so as to allow the water bottle to remain in the upright and vertical position regardless of the orientation of the equipment to which the bracket is mounted. The means by which liquid is withdrawn from the water bottle is neither claimed nor otherwise recited in the invention.

U.S. Pat. No. 5,215,231 to Paczonay discloses an apparatus for supplying water or other liquids to a bicyclist that allows him or her to remain in a riding position while drinking as fully discussed in U.S. Pat. No. 5,301,860 to Paczonay above.

U.S. Pat. No. 4,911,339 to Cushing discloses a bicycle frame mounted water bottle apparatus providing a means for pressurizing the interior thereof so as to expel the liquid contents of the water bottle through a length of tubing running along the frame and out a valve located on the bicycle handlebar. While the invention allows the bicyclist to keep both hands on the handlebars, the means for pressurization is inadequate for discharging any more than a mist or fine stream of water from the valve at a given time. Moreover, this will diminish further with repeated discharges without the benefit of any practical way whatsoever to repressurize the water-bottle while riding.

U.S. Pat. No. 4,441,638 to Shimano discloses a bicycle frame mounted water bottle with a streamlined shape so as to minimize eddy air currents and hence drag. The Shimano invention must still be retrieved from its frame mounted retainer by the bicyclist and inverted to discharge liquid. No other improvements over the prior art are provided.

U.S. Pat. No. 4,815,635 to Porter discloses an apparatus for supplying liquids to a bicyclist while riding. The Porter invention comprises a plurality of reservoirs which contain separate liquids, the reservoirs being connected through respective conduits to a nozzle located on the bicycle handlebar stem. The nozzle incorporates a hand-operated pump mechanism for drawing the fluids from the reservoirs and expelling them from the nozzle. The nozzle can eject either a mist or a stream of liquid. The Porter invention, however requires both the manipulation of the hand-operated pump by the bicyclist while attempting to direct a stream or a mist of liquid as well as the bicyclists' positioning of his head the vicinity of said stream or mist so as to capture the stream in his mouth or have the mist impinge on his face while riding.

U.S. Design Patent Des. 383,875 to Morgan claims an ornamental design for a bicyclists' helmet incorporating an water reservoir. This design is undesirable because it is not directed to an improved water bottle that is compatible with prior art water bottle retention devices. Rather, the ornamental design in the Morgan invention is directed to an improved bicyclists' helmet.

U.S. Design Patent Des. 340,217 to Delage et al claims an ornamental design for a bicycle water bottle having a valve placed at the top of the water bottle, and the water bottle further having a recessed shape. It is evident from the ornamental design of the Delage et al invention that it is incompatible with prior art water bottle retention devices.

U.S. Design Patent Des. 319,421 to Kerezman claims an ornamental design for a bicycle water bottle having an actuating arm and nozzle placed at the top of the water bottle. Because the ornamental design of the Kerezman invention incorporates clamping bosses, it is incompatible with prior art water bottle retention devices.

What is needed, therefore, is a hydration apparatus which provides a minimum of interference with a bicyclist's efficiency, comfort, awareness and safety that is fully compatible with existing carriage and retention systems for prior art bicyclists' hydration apparatuses.

OBJECTS AND SUMMARY OF THE INVENTION

The present invention provides an apparatus for carrying and dispensing water or other liquids to a bicyclist that offers improvements in bicyclist safety, comfort, efficiency and performance over the prior art.

It is therefore an object of the present invention to provide an apparatus for carrying and dispensing liquids while engaged in riding a bicycle.

It is a further object of the present invention to provide an apparatus for carrying and dispensing liquids while engaged in riding a bicycle that allows the bicyclist to remain in an efficient, aerodynamic riding position, without physically or visually impairing the bicyclist's control of the bicycle.

It is still a further object of the present invention to provide an apparatus for dispensing liquids while engaged in riding a bicycle that requires minimal effort from the bicyclist to dispense the liquid.

It is yet still a further object of the present invention to provide an apparatus for carrying and dispensing liquids while engaged in riding a bicycle that is compatible with existing means for carriage and retention of bicycle water bottles.

An additional object of the present invention is to overcome a lack in the prior art of bicyclists' water bottles to provide an apparatus for dispensing liquids while riding that eliminate the need for the bicyclist to significantly alter his or her riding posture to dispense the contents of the water bottle into his or her mouth.

Briefly stated, the present invention achieves these and other objects by providing an apparatus for dispensing water or other liquids to a bicyclist while riding. Invention provides a means for dispensing fluids from its bottom end so as to eliminate the need for inverting. Contents of the bottle are gravity-dispensed so as to eliminate repeated squeezing of bottle to discharge contents. Invention incorporates functional ergonomic elements including recesses for better handhold, concave sections and extended sections to provide a close conformity to a bicyclist's face to both preserve the aerodynamics of the bicyclist and for maintaining adequate clearance for breathing, while drinking from the invention. Invention is compatible with prior art carriage and retention systems.

In the fundamental embodiment of the present invention, an apparatus for dispensing liquid, comprises a vessel having a substantially cylindrical shape where the vessel further comprises a first end and a second end, that are distally opposed along the vessel. A means for filling the vessel is situated at the first end and a means for discharging the vessel situated at the second end. A means for opening and closing the means for filling is provided, including a means for securing to the means for filling. A valve regulates the discharging of the contents of the vessel. A circumferential recess in the vessel is provided for enhance gripping.

According to an alternate embodiment of the present invention, apparatus for an improved bicyclist's water bottle for carriage and retention in prior art bicycle water bottle cages, comprises a body which is substantially cylindrical in shape, a neck portion with an opening, located at the upper part of the body, a closed base portion located at the bottom part of body, and a valve proximately located at the base, where the axis of the valve is substantially orthogonal to the axis of the body.

Still according to both the fundamental and the alternate embodiments of the present invention, an ergonomic concavity in the vessel or body of the invention facilitates breathing while drinking and an ergonomically extended boss onto which the valve is mounted further yet facilitates breathing while drinking.

Still yet, according to both the fundamental and the alternate embodiments of the present invention, a vent means prevents the creation of vacuum while the contents of the vessel are discharged.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
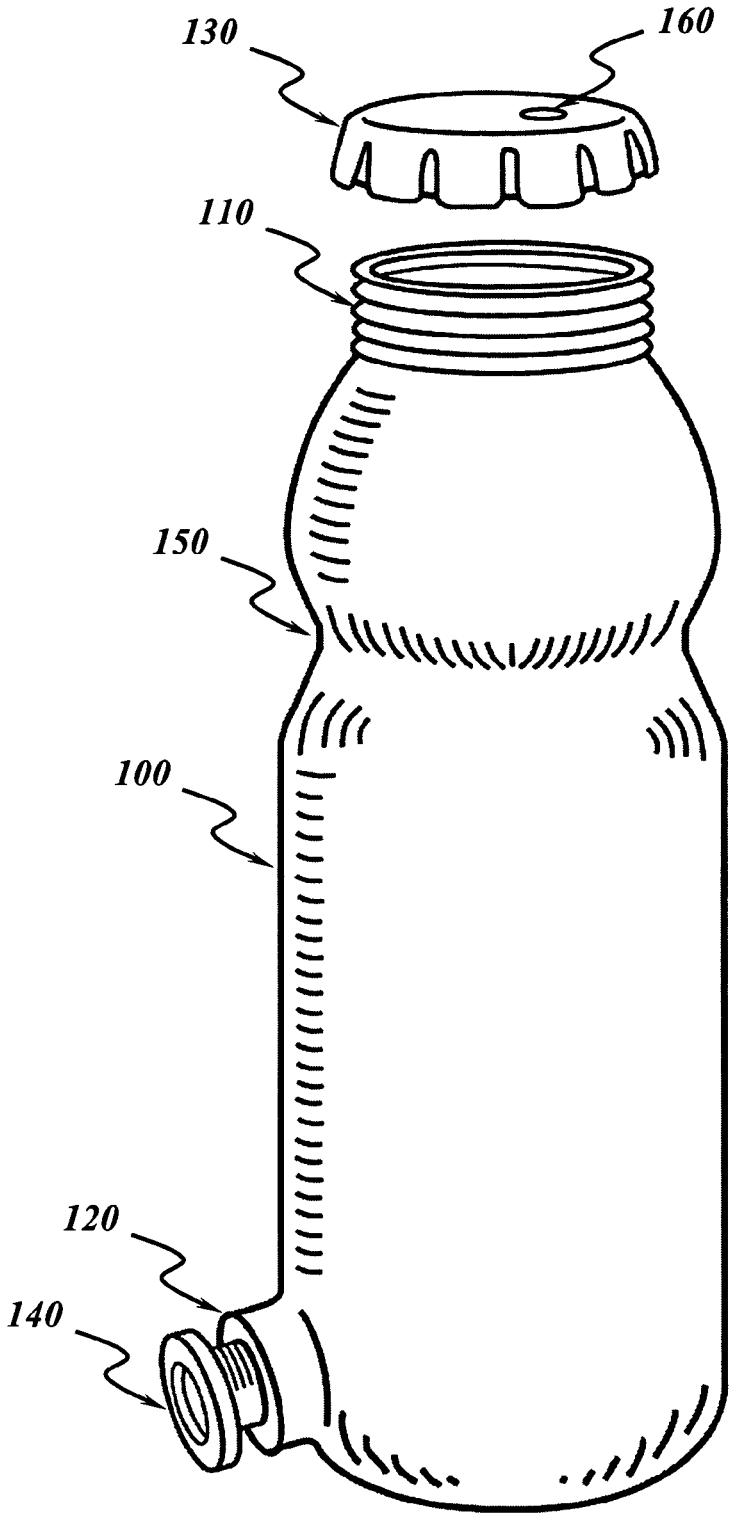
FIG. 1 depicts the present invention with filling cap removed.

Referring to FIG. 1, the present invention, a bicyclist's water bottle with bottom drinking valve is depicted. The invention is predominantly a cylindrically-shaped vessel suitable for containing fluids to be carried on a bicycle. More suitably, the invention is intended to be carried in existing water bottle "cages" mounted on either or both of a bicycle frame down tube or seat tube. The invention, however, is by no means limited to use by bicyclists.

The present invention is primarily a cylindrically-shaped vessel 100 structure manufactured by a molding or extrusion process. It may be fabricated from plastics or metal. The distinctive features of the invention include the means for discharge 120, 140 of fluids contained therein through the bottom of the vessel 100. This is in contrast to prior art devices which discharge from their topmost end, and must be inverted to do so.

The present invention is filled with fluids through an opening at the top. Suitable means is provided to effectuate closure or sealing of the opening of the vessel by providing a removable cap 130 which captively engages a securing means 110. Numerous opening and closure means are within the scope of the present invention including but not limited to caps which engage circumferentially threaded openings (as depicted), snap lock caps in which lips and recesses in the cap engage corresponding recesses or lips in the opening through an interference fit, and caps which are fixed to the opening of the vessel 100 that alternately open or close an orifice or orifices when twisted in one direction or the other. Many other common opening and closure caps would be compatible with the present invention.

The invention also provides one or more contours incorporated into the vessel 100 to enhance handhold. The primary embodiment provides a circumferential concave recess 150 for that purpose, which may be located at any point along the length of the vessel 100.

The primary motivation for the present invention is the need to provide an apparatus that can provide liquids to a bicyclist without the need to invert the vessel in order to discharge the fluid. Another motivation is to eliminate the need to repeatedly squeeze the vessel or to provide suction by mouth to fully discharge the contents of the vessel. All of these manipulations tend to further tax the bicyclist, particularly while engaged in competition. For instance, a competitive bicyclist may find it difficult if not impossible to suck fluid out of a water bottle when he or she is already at the maximum limits of his or her aerobic output. Additionally, the manipulation required by a bicyclist while engaged in competition to invert, to squeeze, and to direct the fluid discharge from a prior art water bottle, places extraordinary demands on the bicyclist's attention and focus to the extent that it poses a serious safety risk to himself or herself and other bicyclists in close proximity.

For this reason, the present invention further provides a boss 120, being either molded into, extruded out of, or otherwise attached onto the vessel 100 at or in proximity of the vessel's base or bottommost end. Boss 120 provides a means into which a valve 140 may be mounted. It is desirable that the boss 120 and valve 140 be mounted near the bottom of the vessel 100 so as to ensure the entire contents of the vessel will be fully discharged through the action of gravity alone. Vent means 160 may be incorporated into the invention to provide for the displacement air so as to avoid the creation of a vacuum which would otherwise impede desired rapid fluid discharge. Vent means 160 may be found more appropriate where vessel 100 is a rigid structure and may be less necessary to the extent vessel 100 is a flexible structure. It is also desirable that boss 120 and valve 140 be oriented nearly orthogonal to the longitudinal axis of the vessel 100 to ensure that a bicyclist or other user of the invention can draw fluid from the invention while it is held upright, without the need to tip, tilt, invert, or otherwise manipulate the invention to make fluid discharge as is a common disadvantage of prior art water bottles. Numerous valve types can be utilized in the present invention. A push/pull valve 140 is shown depicted. However, "bite-on" valves actuated by pressure applied by the teeth would also be amenable for use with the present invention. Check-type valves in which an actuator is depressed by the bicyclist's tongue are also amenable to the invention. It should be further noted that preferred valve types and those in best keeping with the spirit of the present invention are those which can be operated by mouth, thereby leaving the bicyclist's other hand (i.e., the hand not holding the invention) to control the bicycle.

Figure 2:
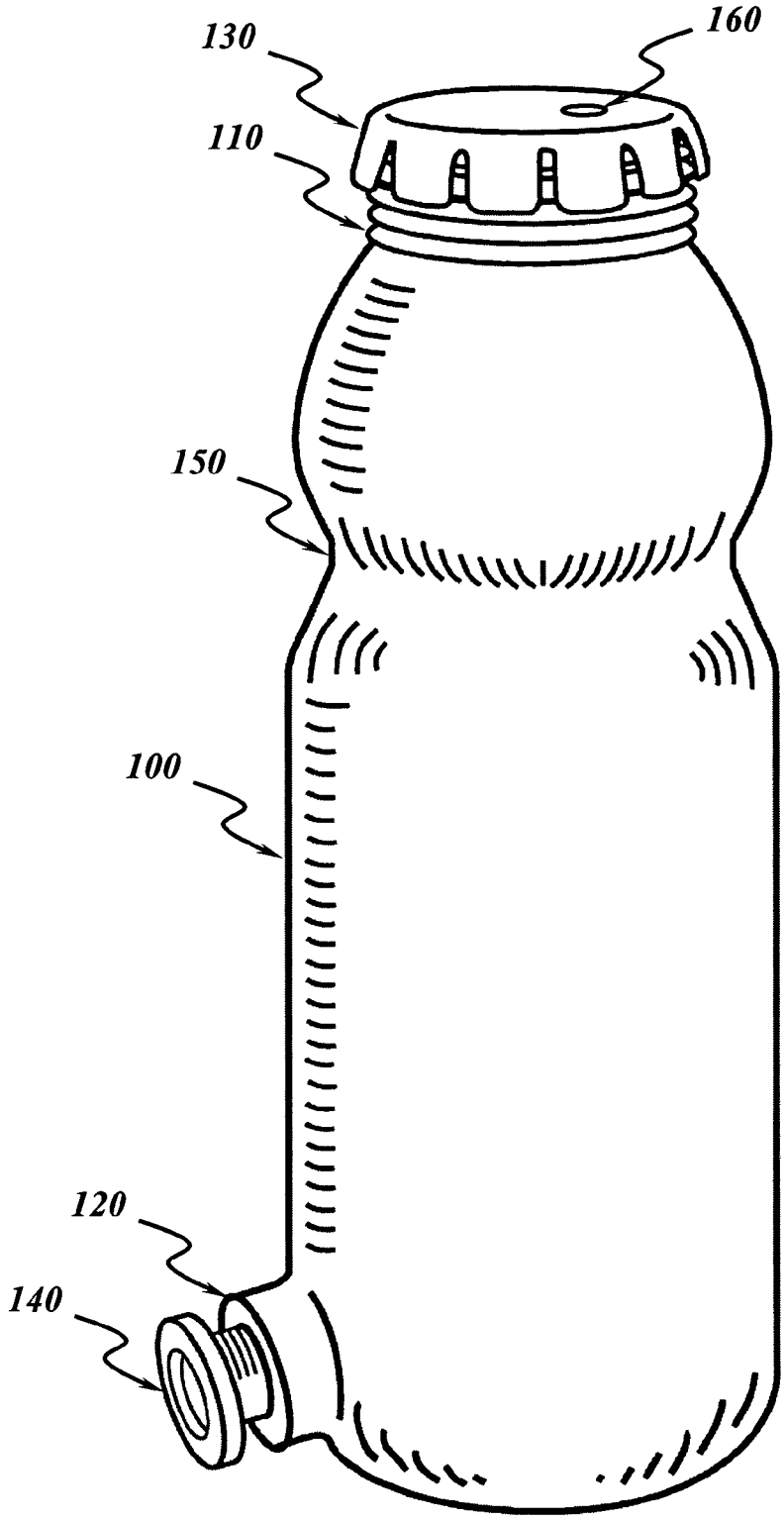
FIG. 2 depicts the present invention with filling cap fastened.

Referring to FIG. 2, the present invention, a bicyclist's water bottle with bottom drinking valve is depicted with removable cap 130 captively engaging securing means 110 to seal vessel 100.

Figure 3:
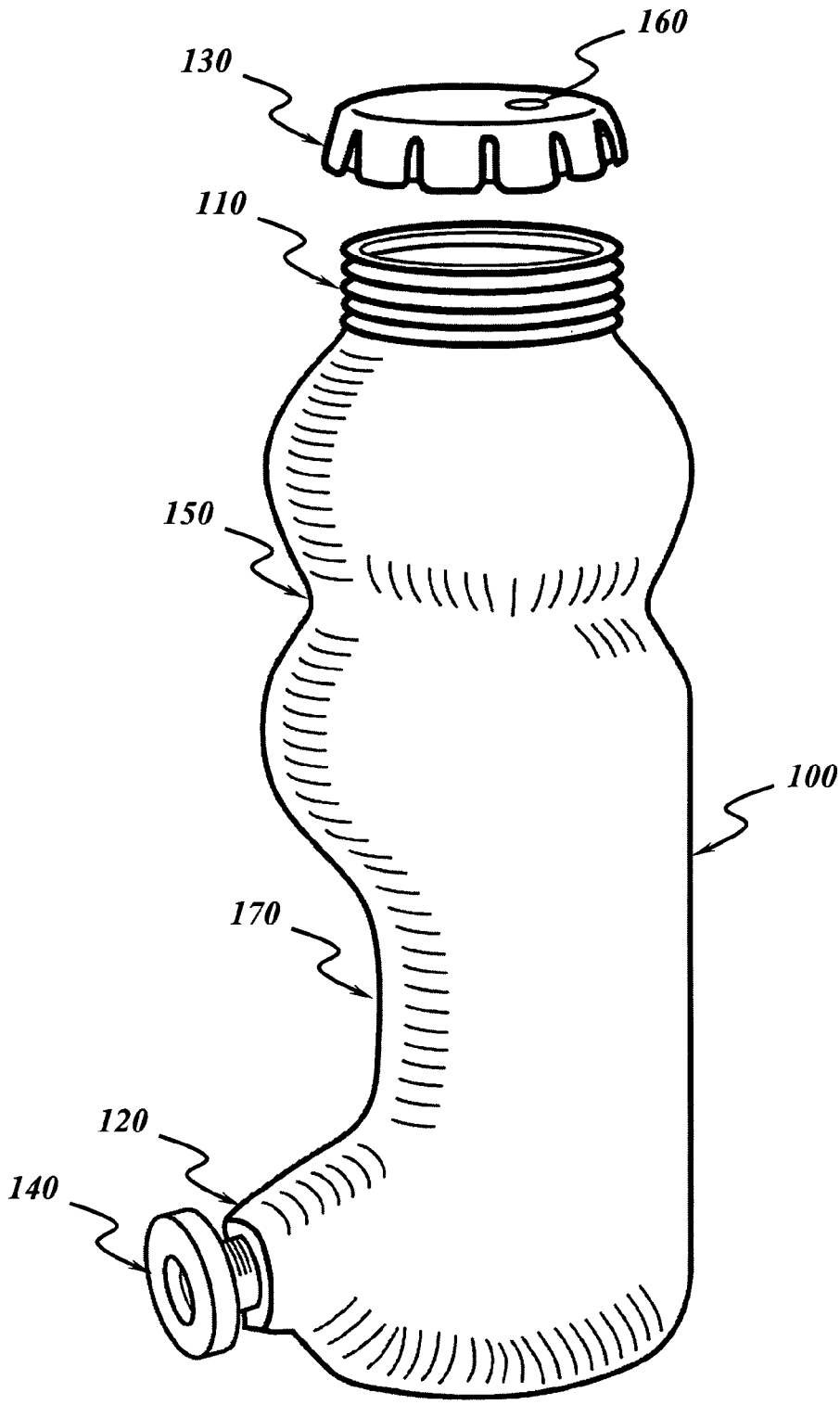
FIG. 3 depicts an alternate embodiment of the present invention with filling cap fastened.

Referring to FIG. 3, the present invention, a bicyclist's water bottle with bottom drinking valve is depicted in an alternate embodiment having enhanced ergonomic features while still retaining the present invention's feature whereby it may be fully discharged of fluid from an upright, vertical orientation. Specifically, vessel 100 can be formed so as to provide a concave recess portion 170 for ergonomic fit to a bicyclist's face by providing clearance for his or her nose. Boss 120 may be formed into an elongation to provide further reach towards a bicyclist's mouth. With the aforesaid ergonomic features, the bicyclist can better secure and steady the invention while drinking from it. It should be noted that while drinking from the invention the bicyclist must breathe through his or her nose. The concave recess portion 170 together with the elongated boss 120, provide the necessary clearance to ensure that the bicyclist's ability to breath through his or her nose while drinking is not compromised.

Figure 4:
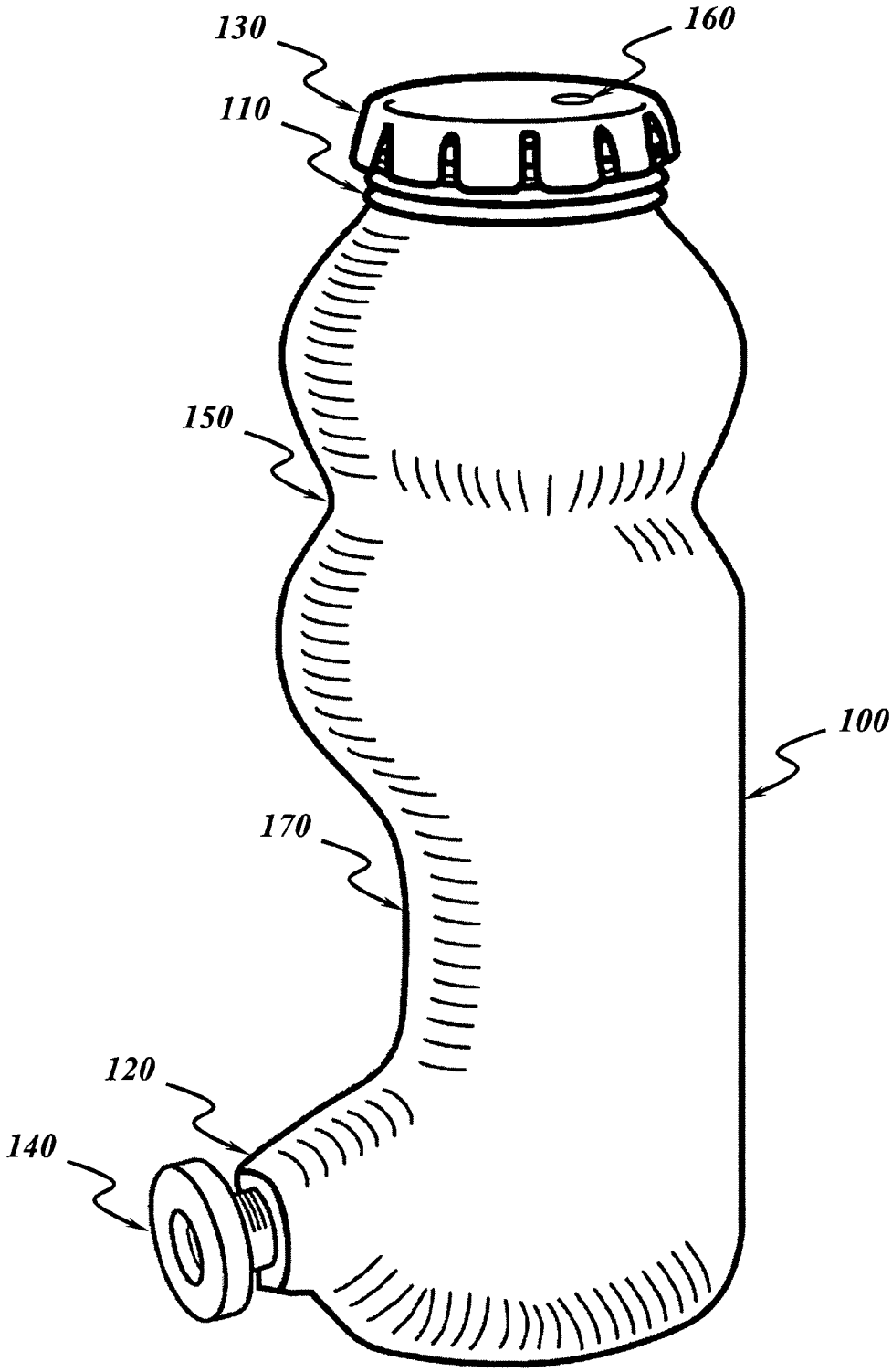
FIG. 4 depicts an alternate embodiment of the present invention with filling cap removed.

Referring to FIG. 4, the present invention, a bicyclist's water bottle with bottom drinking valve is depicted in an alternate embodiment having enhanced ergonomic features is depicted with removable cap 130 captively engaging securing means 110 to seal vessel 100.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is

1. An apparatus for dispensing liquid, consisting of:

a vessel having a substantially cylindrical shape;

said vessel further comprising a first end and a second end, said ends being distally opposed along said vessel;

a means for filling said vessel situate at said first end;

a means for discharging said vessel situate at said second end;

a means for opening and closing said means for filling;

a means for securing said means for opening and closing to said means for filling;

a valve for regulating said means for discharging, wherein said valve is selected from the group consisting of: linear-action push-pull valves; bite valves; twist valves; and check valves;

a symmetrically concave depression being disposed circumferentially about said vessel, forming a handhold for enhancing gripping; said symmetrically concave depression being located substantially proximate to a point midway between said first and said second end of said vessel;

wherein said vessel further comprises a partial cutaway section of said vessel's diameter, and wherein said partial cutaway section is of sufficient depth and shape so as to conform to and provide clearance for a user's nose;

said partial cutaway section is located immediately above, and on the same side of said vessel as, said means for discharging;

wherein said partial cutaway section forms a recess into the side of said body so as to provide fitment to one's face while discharging the contents of said apparatus into mouth; and wherein said means for discharging is located entirely outside and immediately below said recess formed by said partial cutaway section.

2. In the field of bicycling, an improved bicyclist's water bottle for carriage and retention in prior art bicycle water bottle cages, consisting of:

a body which is substantially cylindrical in shape;

a neck portion with an opening, located at the upper part of said body;

said neck portion having an opening and closing means;

a closed base portion located at the bottom part of said body;

a valve proximately located at said base, wherein said valve is displaced at an obtuse angle relative to said body;

a boss portion so as to provide a means to affix said valve to said base; and wherein said body further comprises a partial cutaway section of said body's diameter to facilitate breathing while drinking, wherein said partial cutaway section has sufficient depth and shape so as to conform to and provide clearance for a user's nose;

said partial cutaway section is located immediately above, and on the same side of said vessel as, said means for discharging;

wherein said partial cutaway section forms a recess into the side of said body so as to provide fitment to one's face while discharging the contents of said apparatus into mouth; and wherein said boss portion onto which said valve is affixed is located entirely outside and immediately below said recess formed by said partial cutaway section.

* * * * *